United States Patent [19]

King et al.

[11] 4,034,254

[45] July 5, 1977

[54] COLOR TUBE HAVING CONCENTRIC PHOSPHOR RING PATTERN AND ELECTRON MULTIPLIER CHANNEL PLATE

[75] Inventors: Hewson Nicholas Graham King, Redhill; John Revere Mansell, East Grinstead; Pamela May Stubberfield, Wantage, all of England

[73] Assignee: U.S. Philips Corporation, New York, N.Y.

[22] Filed: Apr. 24, 1975

[21] Appl. No.: 571,402

[30] Foreign Application Priority Data

May 7, 1974 United Kingdom ..... 20020/74

[52] U.S. Cl. ..... 313/400; 313/105 R

[51] Int. Cl.[2] ..... H01J 43/24; H01J 43/22

[58] Field of Search ... 313/105 CM, 105 R, 103 CM, 313/103 R, 104, 461, 470, 400

[56] References Cited

UNITED STATES PATENTS

| | | | |
|---|---|---|---|
| 2,619,608 | 11/1952 | Rajchman | 313/415 X |
| 2,962,623 | 11/1960 | Beintema | 313/397 X |
| 3,260,876 | 7/1966 | Manley et al. | 313/400 |
| 3,860,849 | 1/1975 | Schagen et al. | 313/400 |
| 3,939,374 | 2/1976 | Schagen et al. | 313/95 |

*Primary Examiner*—Robert Segal
*Attorney, Agent, or Firm*—Frank R. Trifari

[57] ABSTRACT

A color cathode ray tube having a screen with concentric phosphor ring patterns and an electron multiplying channel plate between the screen and the electron gun, the channel plate including a focusing control electrode having a constant focusing action.

4 Claims, 2 Drawing Figures

Figure 1:
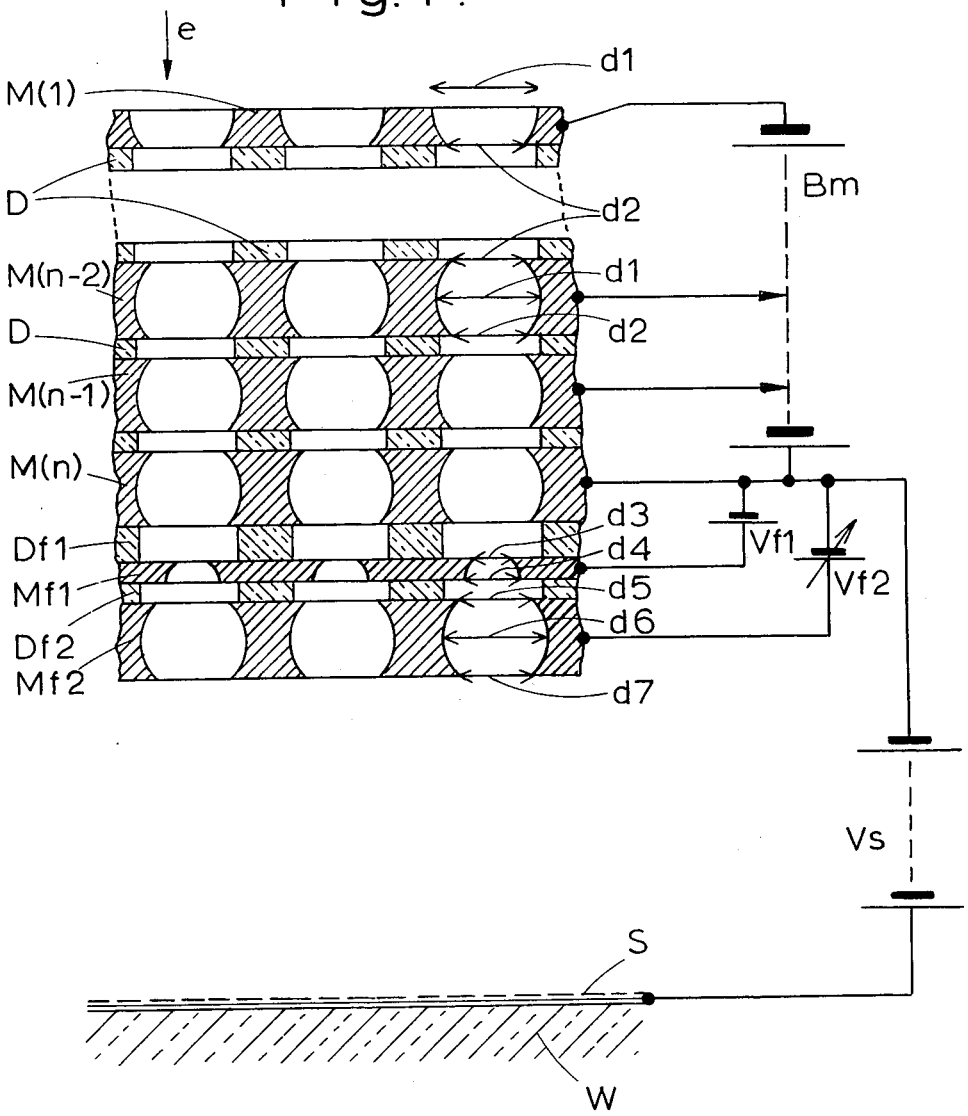

COLOR TUBE HAVING CONCENTRIC PHOSPHOR RING PATTERN AND ELECTRON MULTIPLIER CHANNEL PLATE

This invention relates to electron multipliers and more particularly to electron multipliers of the channel plate type. The invention can be applied with particular advantage to channel plates used in electronic imaging and display tubes for multi-colour display applications.

During investigations into laminated or discrete-dynode channel plates for large-area displays it was discovered that the outgoing electrons were emitted as hollow beams so as to form a pronounced ring on the screen in front of each channel. We have observed this effect also in continuous-dynode channel plates of conventional type and of the type described in U.S. patent application Ser. No. 431,016, filed Jan. 7, 1974.

It has been found possible to make use of such hollow electron beam formations in such manner as to perform control and selection functions. In particular U.S. patent application Ser. No. 461,539, filed Apr. 17, 1974 describes an electron beam device comprising a channel plate structure of such form as to cause the final electrons to be emitted in hollow beams, a target parallel to the output face of said structure, and a focusing control electrode between said structure and target which electrode has apertures aligned with the channels of said channel plate structure and is provided to vary the overall width of said beams when varying focus potentials are applied thereto, said target having an array of patterns of concentric areas having differing responses to electrons bombardment and each of said patterns being aligned with an aperture of the focusing control electrode in such manner that said varying focus potentials can control the electron beams so as to cause them to land on differing selected areas of said patterns.

According to a feature of the said patent application Ser. No. 461,539, the device may be one wherein the target is a display screen and wherein each pattern of its array is a multi-colour phosphor pattern with concentric areas adapted to luminesce in differing colours.

With such devices it has been found that some electrons generated in the early stages of multiplication in the channel plate strike the screen directly thus causing unwanted multiple rings and are difficult to focus. It is the main object of the present invention to reduce or minimize these effects.

The invention provides an improvement in or modification of the devices described in the parent patent application Ser. No. 461,539 wherein an additional focussing electrode is provided between the final electrode of the channel plate and the focusing control electrode for the purpose of applying a degree of constant focusing action to the hollow beams of individual channels while control of their diameter is applied by said focusing control electrode.

The additional focusing electrode is provided for the purpose of improving the sharpness of the ring (or dot) patterns of the electrons landing on the screen. When appropriate potentials are applied to the various electrodes this is achieved in two ways which can best be described with respect to a discrete dynode channel plate. First, the additional electrode intercepts electrons which may arrive direct from stages preceding the final dynode and will thus have greater energies which will render them relatively unresponsive to the action of the final control electrode. Secondly, it focuses electrons generated by the last dynode so as to prevent them from landing on the final control electrode (if this were to happen, the resultant secondaries would escape the focus and control action of the two focusing electrodes and would land over a wide area of the screen). These two complementary functions can best be performed if the apertures in the additional focusing electrode are smaller than the cross-sections of the channels of the channel plate.

Of course, if the channel plate is of the continuous dynode type, the action of the additional focusing electrode still corresponds to the functions just described.

As in the case of the patent application Ser. No. 461,539, a preferred arrangement employs as the channel plate a laminated structure wherein the dynodes are separated from each other and arranged in cascade with aligned apertures providing the channels. In this case its output dynode has a dominant effect on the form of the hollow beams and said output dynode may be of the kind described and claimed in U.S. patent application Ser. No. 456,374, filed Mar. 29, 1974. In the embodiment described below, a channel plate structure of the laminated type comprises a plurality of such dynodes. The said embodiment also incorporates the preferred features that the additional focusing electrode (referred to hereinafter as the constant focus electrode) is thinner than the focussing control electrode and has smaller apertures than the latter.

In other examples the laminated structure is replaced by a thin plate of continuous dynode type having flared channels in accordance with the aforesaid patent application Ser. No. 431,016. If such channels are non-circular in cross-section (for example pyramidal) then the concentric target patterns may also be non-circular.

Figure 2:
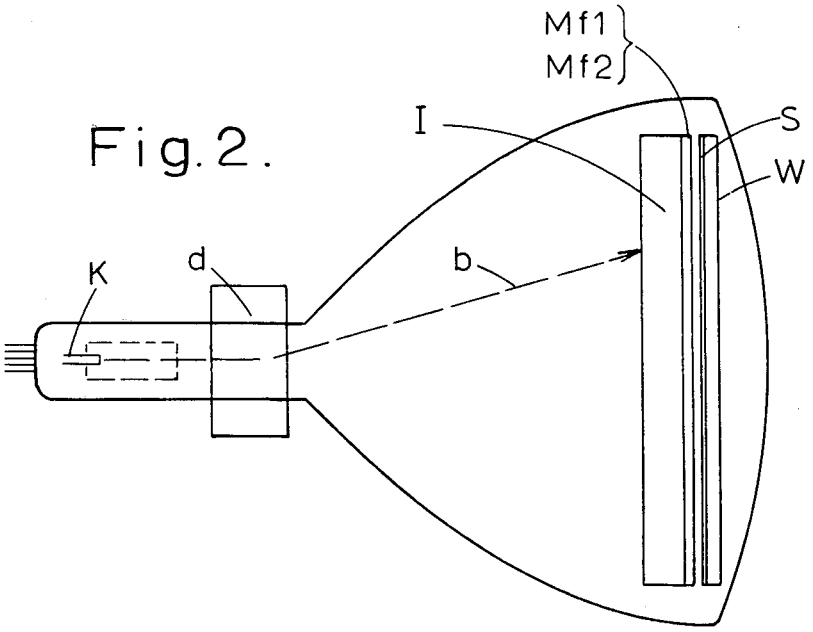

An embodiment of the invention applied to a colour display tube will now be described by way of example with reference to the diagrammatic drawings accompanying the Provisional Specification wherein:

FIG. 1 shows focussing means according to the invention applied to a laminated channel plate structure in accordance with the said patent application Ser. No. 456,374, and FIG. 2 shows a C.R.T. construction incorporating this invention.

Referring to FIG. 1, the dynode apertures of a channel are shown as having symmetrical configurations which are substantially spherical with input and output diameters equal or approximately equal to each other and to the dynode thickness.

Most of the output electrons from a dynode M(n) cross over the channel axis as they pass electrodes Mf1-Mf2 so as to form a hollow beam and land on the screen S in such manner as to form a luminous ring (screen S is formed on a support W which may be a separate plate or the window of a C.R.T.).

As in the case of the patent application Ser. No. 461,539, an electrode M*f*2 acts as a focussing control electrode and by varying the voltage V*f*2 between it and the final dynode, it is possible to vary the size of this ring and to reduce it to a spot. In the case of FIG. 1 the control electrode M*f*2 is shown identical (in form and spacing) with the dynodes M($n$) and M($n$-1), the only difference being the variable focus potential V*f*2 applied to it for control purposes.

By forming the screen S as a pattern of concentric phosphor areas of three different colours (the inner colour being a dot) in front of each channel, it is possible to change the colour of the display by varying V*f* so that the focus control electrode M*f*2 acts as a colour selector electrode.

In the arrangement shown in FIG. 1 in fragmentary axial section the metal plates M(1)-M(*n*) (which act as discrete dynodes) have re-entrant apertures in accordance with patent application Ser. No. 456,374 with maximum diameter *d*1 and minimum diameters *d*2. Methods of manufacture are described in the said application, and need not be repeated here except to restate that the spherical form is in no way essential or even the best and that, if the dynodes are made from two symmetrical halves, then the first dynode M(1) can be constituted by one such half-plate.

The channel plate may employ, say, ten dynodes. The last three stages of the channel plate are shown having metal dynodes M(*n*-2), M(*n*-1) and M(*n*) and all dynodes are separated from each other by insulating separator layers D. Since plate M(*n*) is the last one of the series, it takes the place of the output electrode of a continuous-dynode channel plate. Similarly, the first plate M(1) takes the place of the input electrode of a continuous-dynode channel plate.

In operation, all the M plates or dynodes are fed, as shown, with increasing potentials by a D.C. supply source shown schematically as a tapped unit Bm.

In accordance with the present invention the channel plate is followed by an additional focusing electrode M*f*1 having apertures with preferably smaller diameters (*d*3 - *d*4), the said electrode being spaced from M(*n*) by an insulating layer Df1. This electrode should not act as a dynode i.e. it should not contribute to the multiplication process. It has a constant potential V*f*1 applied to it which is less than potential V*f*2.

Electrode M*f*1 is followed by a further insulating layer D*f*2 carrying the focus control electrode M*f*2, which in this example, has the same form and dimensions as the dynode M(*n*). Thus it has the same thickness and its dimensions *d*5 - *d*7 and *d*6 are respectively the same as the diameters *d*1 - *d*2 of a dynode. Steps may need to be taken to prevent unwanted secondary emission from electrode M*f*2, e.g. it may be desirable to out back its output edges so that *d*7 becomes greater than *d*5.

One possible set of practical values suitable for the arrangement of FIG. 1 is given below by way of illustration for a case in which the maximum diameter (*d*1) of the dynode apertures is slightly greater than it would be in the spherical case (in the following Table the diameters *d*3–d4 of grid M*f*1 are given differing values so as to correspond to the flared form shown in FIG. 1; although this form is convenient in that it can readily be obtained by etching, it is in no way essential and parallel holes can be used with diameter *d*4 reduced to the same value as *d*3):

TABLE

| | | | |
|---|---|---|---|
| Diameter | d1 | = | 0.53mm |
| " | d2 | = | 0.32" |
| " | d3 | = | 0.15" |
| " | d4 | = | 0.27" |
| " | d5 | = | 0.32" |
| " | d6 | = | 0.53" |
| " | d7 | = | 0.32" |
| Thickness of M(1) | | = | 0.15" |
| Thickness of M(2)-M(n) | | = | 0.30" |
| Thickness of Mf1 | | = | 0.07" |
| Thickness of Mf2 | | = | 0.30" |
| Thickness of a layer D | | = | 0.10" |
| Thickness of a layer Df1 | | = | 0.20" |
| Thickness of layer Df2 | | = | 0.10" |
| Distance from Mf2 to screen | | = | 6.00" approximately |
| Potential | Vf1 | = | 30 V |

TABLE-continued

| | | | |
|---|---|---|---|
| Potential | Vs | = | 4000 V approximately |
| Potential | Vf2 | = | switchable to 0 V, 60 V and 140 V for three colours. |

As in the case of the patent application Ser. No. 461,539 for cathode-ray colour television display tubes of large diameter the capacitance of the tri-colour switching system M*f*2 may in practical cases preclude switching at dot-sequential frequency in accordance with incoming PAL, NTSC or like signals. However, use of the system can still be made possible by displaying the colour information line-sequentially. Thus British patent specification No. 1331938 provides improved display circuitry whereby colour information can be presented line-sequentially without requiring an increase in line frequency, and consequently in bandwidth, to avoid the appearance of colour creep or colour flicker, and substantially without loss of video information.

The present invention has particular advantages in applications requiring large-area viewing screens, for example radar and television display C.R.T. applications and large image intensifiers. Thus in application the input dynode is scanned by an electron beam whereas in image-intensifier applications the input electrons *e* are provided by a photo-cathode.

As for the form of the target, each phosphor pattern need only be concentric and aligned with a channel in the sense explained in the patent application Ser. No. 461,539 and the display screen can be varied in a number of ways described therein.

FIG. 2 shows schematically a cathode-ray tube having an electron gun G(with cathode K) for generating a beam *b* which is deflected by deflection means *d* so as to scan the input face of a channel plate I. The latter may be as described with reference to FIG. 1 and therefore the details of its structure and power supplies will not be repeated. A multi-colour display screen S is provided, as before, on a support W which may be a separate glass plate (as shown) or the face-plate of the tube. The focus electrodes are shown at M*f*1 – M*f*2.

In the examples described with reference to FIGS. 1 and 2 the hollow electron beams can be constricted by the action of the focus control electrode until they cease to be hollow (at least at the screen) and thus form, on the screen, continuous spots as opposed to rings. As explained in the patent application Ser. No. 461,539, this is not essential to the invention and there may be circumstances in which it is desirable to operate with target patterns having for example, two concentric phosphor rings without a central phosphor dot. If the two phosphors are red and green (e.g. in a data display application) a third colour (yellow) can be obtained by focusing each hollow beam to an intermediate width where it excites parts of both phosphor rings.

What is claimed is:

1. A color cathode ray tube comprising an electron gun to generate an input electron beam, an electron multiplying, dynode channel plate structure having an input face opposite said gun and an output face emitting the outgoing electrons in hollow beams, a viewing screen arranged parallel to said output face; a focusing control electrode between said structure and said screen which electrode has apertures aligned with the channels of said structure and is provided to vary the overall width of said outgoing beams when varying focus potentials are applied thereto; said screen including an array of phosphor patterns arranged in concentric areas having different color responses to electron bombardment and each of said patterns being aligned with an aperture of the focusing control electrode in such manner that said varying focusing potentials can control the outgoing electron beams so as to cause them to land on differing selected areas of said patterns; and an additional focusing electrode provided between the final dynode of the channel plate structure and said focusing control electrode, said additional electrode being thinner than said focusing control electrode and said additional electrode having apertures aligned with and smaller in cross-section than the channels of said structure to apply a degree of a constant focusing action to the hollow beams of individual channels while control of the diameter of said outgoing beams is performed by said focusing control electrode.

2. A tube as claimed in claim 1 wherein the additional focusing electrode has smaller apertures than the focusing control electrode.

3. A tube as claimed in claim 1, further comprising means for applying a cyclically varying control voltage to the focusing control electrode so as to produce cyclical changes in the colour of the display, and means for applying a constant focusing voltage to the additional focusing electrode.

4. An electron beam device comprising in an evacuated envelope, a source of an input electron beam, an electron multiplying dynode channel plate structure having an input face opposite said input beam generating means and an output face emitting the outgoing electrons in hollow beams, a target arranged parallel to said output face; a focusing control electrode between said structure and said target which electrode has apertures aligned with the channels of said structure and is provided to vary the overall width of said outgoing beams when varying focus potentials are applied thereto; said target including an array of patterns arranged in concentric areas having different responses to electron bombardment and each of said patterns being aligned with an aperture of the focusing control electrode in such manner that said varying focusing potentials can control the outgoing electron beams so as to cause them to land on differing selected areas of said patterns; and an additional focusing electrode provided between the final dynode of the channel plate structure and said focusing control electrode, said additional electrode being thinner than said focusing control electrode and said additional electrode having apertures aligned with and smaller in cross-section than the channels of said structure to apply a degree of a constant focusing action to the hollow beams of individual channels while control of the diameter of said outgoing beams is performed by said focusing control electrode.

* * * * *